US005150525A

United States Patent [19]

Iai

[11] Patent Number: 5,150,525

[45] Date of Patent: Sep. 29, 1992

[54] DRAWING DEVICE FOR USE IN DRAFTING MACHINE

[75] Inventor: Kenichiro Iai, Kurobe, Japan

[73] Assignee: Yoshida Kogyo K.K., Tokyo, Japan

[21] Appl. No.: 672,574

[22] Filed: Mar. 20, 1991

[30] Foreign Application Priority Data

Mar. 20, 1990 [JP] Japan ..... 2-27625

[51] Int. Cl.[5] ..... B43L 13/00

[52] U.S. Cl. ..... 33/18.1; 401/65; 346/139 C

[58] Field of Search ..... 33/18.1, 1 M; 401/65; 346/139 C, 139 R

[56] References Cited

U.S. PATENT DOCUMENTS

| | | | |
|---|---|---|---|
| 4,015,269 | 3/1977 | Edo | 346/139 C |
| 4,180,339 | 12/1979 | Katz | 401/65 |
| 4,346,392 | 8/1982 | Isobe et al. | 33/1 M |
| 4,490,061 | 12/1984 | Katz | 401/65 |
| 4,704,797 | 11/1987 | Iai | 33/18.1 |
| 4,905,016 | 2/1990 | Kobayashi et al. | 346/139 C |

FOREIGN PATENT DOCUMENTS

| | | | |
|---|---|---|---|
| 57-5193 | 1/1982 | Japan . | |
| 57-36879 | 8/1982 | Japan . | |
| 62-41585 | 3/1987 | Japan . | |
| 0252597 | 8/1990 | Japan | 33/18.1 |

*Primary Examiner*—William A. Cuchlinski, Jr.
*Assistant Examiner*—Alvin Wirthlin
*Attorney, Agent, or Firm*—Hill, Van Santen, Steadman & Simpson

[57] ABSTRACT

A drawing device for use in a drafting machine includes one length of long casing; a lead guide fixedly secured to the leading end of the casing; one length of pipe member inserted from the other end side of the casing into the same in such a manner as to be axially slidably moved freely; a piece of chuck ring fixedly secured to the interior of the leading end portion of the pipe member; a piece of sleeve fitted closely over and fixedly secured to the outer peripheral surface of the other end side portion of the pipe member; one length of lead stock inserted from the other end side of the pipe member into the same in such a manner as to be slidably moved freely; and a lead chuck fixedly secured to the leading end portion of the lead stock in such a manner that its leading end side portion may be radially deformed or expanded and contracted in cooperation with the chuck ring, and is characterized by further comprising a regulating piece fitted over the rear end of the lead stock in such a manner as to be slidably moved freely by a predetermined stroke; and an auxiliary compression coiled spring mounted between the regulating piece and the sleeve so as to normally bias the regulating piece towards the longitudinal rear end side of the lead stock.

2 Claims, 6 Drawing Sheets

THE PRIOR ART

DRAWING DEVICE FOR USE IN DRAFTING MACHINE

BACKGROUND OF THE INVENTION

1. Field of the Invention

This invention relates to a drawing device for use in a drafting machine, and more particularly to a drawing device arranged such that a lead can be thrust out continuously and sequentially and drawing operation can be conducted with a sufficient drawing pencil depressing pressure.

2. Description of the Prior Art

Drawing devices for use in drafting machines adapted to thrust a pencil lead automatically and sequentially are known, for example, from Japanese Patent Publication NO. SHO 57-36879, and Japanese Utility Model Publication NO. SHO 57-5193, etc..

Since such prior art drawing devices for use in drafting machines are not provided with any special mechanism to expel or remove the residual lead, it is necessary to conduct normal lead thrusting operations repeatedly to enable the residual lead to be pushed out by the next new lead. Therefore, the residual lead expelling operation per se is troublesome and takes a long time.

As a drawing device for a drafting machine which solves such a disadvantage, there is proposed an arrangement shown in Japanese Utility Model Laid-open Publication NO. SHO 62-41585.

This drafting device is arranged as shown in FIG. 6 such that a casing "b" provided at its leading end with a lead guide "a" is mounted on a base "c"; a pipe member "e" having on the leading end side thereof a chuck ring "d" fixedly secured thereto is inserted in the casing "b" so as to be vertically slidably moved freely; a lead stock "g" provided at its leading end with a lead chuck "f" is inserted in the pipe member "e" so as to be slidably moved freely; a coiled spring "h" is mounted between the lead stock "g" and the chuck ring "d" so as to bias and hold the lead chuck "f" at a position where it is radially deformed or contracted by the chuck ring "d", the base "c" is provided with a driving arrangement "i" for vertically moving the pipe member "e" and a stopper "j" for controlling the upward movement of the lead stock "g", the arrangement being made such that when the pipe member "e" is moved up and down by means of the driving arrangement "i" the lead can be thrust out sequentially, and when the pipe member "e" is moved further above a position where the lead stock "g" is abutted against the stopper "j" the lead chuck "f" is deformed so as to expand radially to thereby enable the next new lead to drop from the lead stock "g" and to abut against the residual lead.

In such a drawing device for use in a drafting machine, since lead thrusting operation is conducted by lowering the pipe member "e" so as to thrust a lead held by the lead chuck "f" out from a lead guide "a", and then raising the pipe member "e" to allow the lead chuck "f" to release the lead while the lead is held by the lead guide "a", if the lead holding force of the lead stock "f" is increased; that is, the resilient force of the coiled spring is increased, then upon upward movement of the pipe member "e", the lead chuck "f" does not release the lead and is moved upwards together with the lead held thereby, thereby rendering it unable to thrust the lead out. Therefore, the lead holding force of the lead chuck "f" is set to be somewhat weak.

Therefore, in case the lead powder deposits on the lead chuck "f" or the diameter of the lead is thinner than a predetermined value, there is a tendency of the lead moving upward relative to the lead chuck "f" by the action of the drawing pencil depressing pressure exerted on a drawing paper when drawing operation is conducted, thus rendering it unable to provide a sufficient drawing pencil depressing pressure.

SUMMARY OF THE INVENTION

The present invention has been contemplated in view of the above-mentioned circumstances and for eliminating the disadvantages in the prior art, and has for its object to provide a drawing device for use in a drafting machine arranged such that a drawing pencil can be thrust out continuously and sequentially and drawing operation can be conducted with a satisfactory drawing pencil depressing pressure.

To achieve the above-mentioned object, according to the present invention, there is provided a drawing device for use in a drafting machine including one length of long casing fixedly secured to a base serving as a holder; a lead guide fixedly secured to the leading end of the casing; one length of long pipe member inserted from the other end side of the casing into the same in such a manner as to be axially slidably moved freely; a piece of chuck ring fixedly secured to the interior of the leading end portion of the pipe member; a piece of sleeve fitted closely over and fixedly secured to the outer peripheral surface of the other end side portion of the pipe member, the sleeve being connected to a driving arrangement; one length of lead stock whose leading end is inserted from the other end side of the pipe member into the same in such a manner as to be slidably moved freely and in opposed relationship to the rear end of the chuck ring, the lead stock having a centrally and axially extending lead insertion hole formed in the leading end side thereof, and also a lead stock space formed therein so as to extend axially from the lead insertion hole to the rear end side thereof; a lead chuck fixedly secured to the leading end portion of the lead stock in such a manner that its leading end side portion may be radially deformed or expanded and contracted in cooperation with the chuck ring, the lead chuck having a centrally extending lead insertion hole formed therein and in aligned relationship with the lead insertion hole in the lead stock; a piece of compression coiled spring mounted between the chuck ring and the lead stock so as to bias normally the lead stock and the lead chuck to the rear end side in the longitudinal direction relative to the pipe member and the chuck ring; and means for radially deforming or contracting the lead chuck to enable the lead chuck to hold a lead firmly when the lead chuck is biased to the rear end side relative to the chuck ring by the resilient force of the coiled spring, characterized in that it further comprises a regulating piece fitted over the rear end of the lead stock in such a manner as to be slidably moved freely by a predetermined stroke; and an auxiliary compression coiled spring mounted between the regulating piece and the sleeve so as to normally bias the regulating piece towards the longitudinal rear end side of the lead stock, and a knocker provided movably up and down above said regulating piece so as to move the same down.

As is apparent from the above-mentioned aspect, the drawing device for use in a drafting machine according to the present invention comprises the regulating piece mounted on the upper part of the lead stock so as to be slidably moved freely by a predetermined stroke, the auxiliary coiled spring mounted between the regulating piece and the upper end of the pipe member so as to bias the regulating piece upwards beyond the predetermined stroke, and the knocker for lowering the regulating piece, and is arranged such that when drawing operation is made the knocker is moved upwards away from the regulating piece so that the resilient force of the auxiliary coiled spring can be used as the lead holding force of the lead chuck, whilst when the lead is thrust out the regulating piece is moved downwards by means of the knocker so that the resilient force of the auxiliary coiled spring cannot be utilizing as the lead holding force of the lead chuck.

The above-mentioned and other objects, aspects and advantages of the present invention will become apparent to those skilled in the art when reference is made to the following description and accompanying drawings in which preferred embodiments incorporating the principles of the present invention are shown by way of example only.

DETAILED DESCRIPTION OF THE PREFERRED EMBODIMENTS

The present invention will now be described in detail hereinbelow by way of several embodiments thereof with reference to the accompanying drawings.

Figure 1:
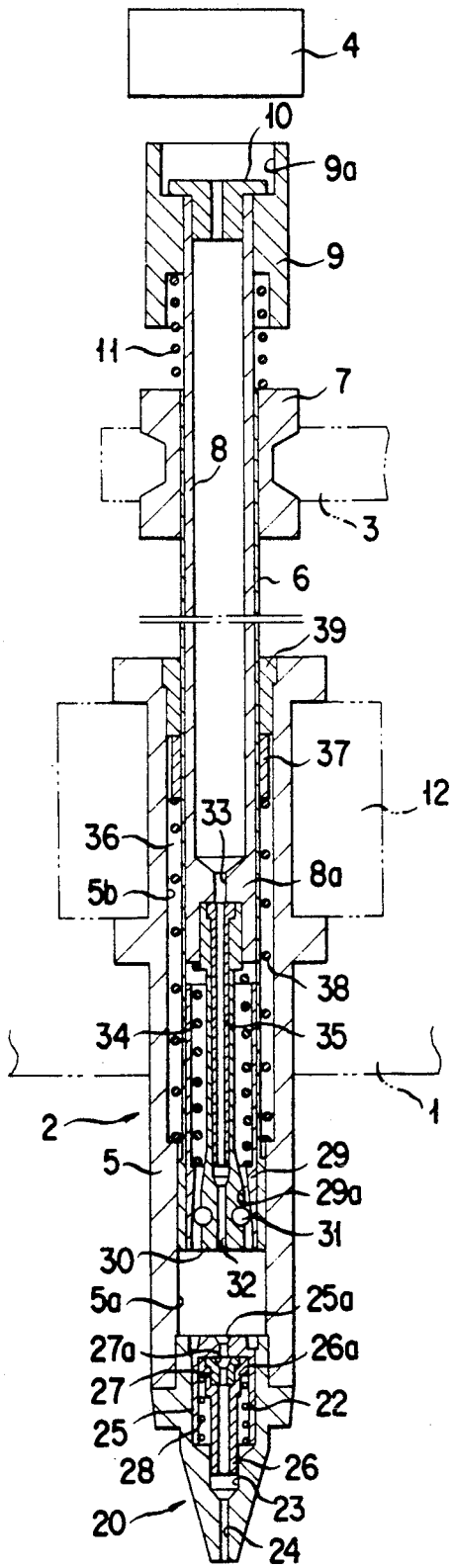
FIG. 1 is a longitudinal sectional view showing a first embodiment of the present invention.

Referring to FIG. 1 which is a longitudinal sectional view of a drawing device for use in a drafting machine according to the present invention, the drawing device comprises a base 1 which serves as a holder movable by a moving arrangement, not shown, in any desired direction in parallel to a drawing paper, and which has mounted thereon a drawing pencil 2, a driving arrangement 3, and a knocker 4. The drawing pencil 2 has a cylindrical casing 5 in which a pipe member 6 is slidably inserted. The upper, outer peripheral portion of the pipe member 6 projecting from the casing 5 has a sleeve member 7 integrally mounted thereon. Further, a lead stock 8 is slidably inserted in the inner periphery of the pipe member 6. Still further, a cylindrical regulating piece 9 is slidably fitted over the outer peripheral surface of the upper part of the lead stock 8, and a stopper 10 is fitted in an fixedly secured to the inner peripheral surface of the uppermost end of the lead stock 8. An auxiliary compression coiled spring 11 is provided between the above-mentioned sleeve member 7 and the regulating piece 9 in such a way as to bias the regulating piece 9 upwards until it is abutted against the stopper 10. The stopper 10 is accommodated in an upper recess 9*a* of the regulating piece 9. Located above the regulating piece 9 is the above-mentioned knocker 4 which is adapted to be moved up and down by means of, for example, a rotary solenoid or air cylinder, not shown.

The above-mentioned casing 5 is held by the base 1 through a holder 12 fixedly secured to the latter. The above-mentioned driving arrangement 3 is a two-forked member which is movable up and down by a driver unit, not shown, and which is connected to the above-mentioned sleeve 7.

In the next place, the details of the drawing pencil 2 will be described.

Mounted on the leading end of the cylindrical casing 5 is a lead guide 20, which has a large diameter hole 22, a small diameter hole 23, and a lead insertion hole 24 formed continuously and concentrically therein. A holder cylinder 25 is tightly fitted in and fixedly secured to the large diameter hole 22. A bushing 26 is vertically, movably inserted in both the holder cylinder 25 and the small diameter hole 23. The bushing 26 has an upper hole 26*a* having a large diameter and in which a lead holder bushing 27 made of rubber is fitted. The lead holder bushing 27 has a hole 27*a* formed therein concentrically with an inlet 25*a* for a lead formed in the holder cylinder 25. Both the inlet 25*a* for a lead and the hole 27*a* are upwardly enlarged or divergent, funnel-shaped to facilitate insertion of the lead. The bushing 26 is biased by the resilient force of a compression coiled spring 28 at its upper position where it is abutted against the upper portion of the holder cylinder 25, and is also adapted to be moved to its lower position against the biasing force of the coiled spring 28 to thereby enable it to abut against the bottom of the small diameter hole 23.

Fitted in and fixedly secured to the lower part of the pipe member 6 slidably inserted in the casing 5 is a chuck ring 29 whose inner peripheral surface 29*a* is of a downwardly enlarged or divergent configuration. Steel balls 31 fitted in the outer peripheral surface of the lower part of a lead chuck 30 are held in pressure contact with the inner peripheral surface 29*a*.

The above-mentioned lead chuck 30 has an open slit 32 formed in the lower part thereof so as to permit its diametral deformation, i.e., expansion and contraction. The upper part of the lead chuck 30 is fitted in and fixedly secured to the bottom 8*a* of the cylindrical lead stock 8 slidably inserted in the upper part of the pipe member 6. A lead insertion hole 33 perforated in the bottom portion 8*a* of the lead stock 8 is open concentrically with the lead chuck 30. Further, a coiled spring 34 is mounted between the chuck ring 29 and the lower end surface of the lead stock 8. The lead chuck 30 is biased upwards relative to the chuck ring 29 by the resilient forces of the compression coiled spring 34 and the above-mentioned auxiliary compression coiled spring 11.

Stating in brief, since the lead stock 8 is biased upwards relative to the pipe member 6 by the resilient forces of the auxiliary coiled spring 11 and the coiled spring 34, the lead chuck 30 fitted in and fixedly secured to the lead stock 8 is biased upwards relative to the chuck ring 30 fitted in and fixedly secured to the pipe member 6.

As a result, the steel balls 31 are urged in contact with the inner peripheral surface 29*a* of the chuck ring 29 so that the lead chuck 30 may deform or contract diametrally to hold the lead firmly thus increasing the lead holding force of the lead chuck 30.

A lead guide 35 is fitted over the upper part of the above-mentioned lead chuck 30 and serves to guide a pencil lead which drops from the lead insertion hole 33 to ensure dropping of it towards the inlet 25*a* for a lead formed in the above-mentioned holder cylinder 25.

The above-mentioned casing 5 is a cylindrical member comprised of a lower portion 5*a* having a small inside diameter, and an upper portion 5*b* having a large inside diameter. The lower portion of the pipe member 6 is slidably inserted in the small diameter lower portion 5*a*, whilst an annular space 36 is defined between the large diameter upper portion 5*b* and the pipe member 6. Further, a ring-shaped engaging piece 37 fixedly secured to the outer peripheral surface of the approximately intermediate portion of the pipe member 6 is arranged to be slidably moved in and along the annular space 36. The engaging piece 37 is biased upwards by the resilient force of the compression coiled spring 38 so as to abut against a ring shaped stopper 39 fixedly secured by screwing-in or press fitting to the open end of the large diameter upper portion 5*b*. Thus, a sleeve position keeping arrangement is provided for holding the sleeve 7 fixedly secured to the outer peripheral surface of the pipe member 6 projecting from the casing 5 such that it may always assume a predetermined and fixed position.

In the next place, the operation of the above-mentioned drawing device is described below.

Figure 2:
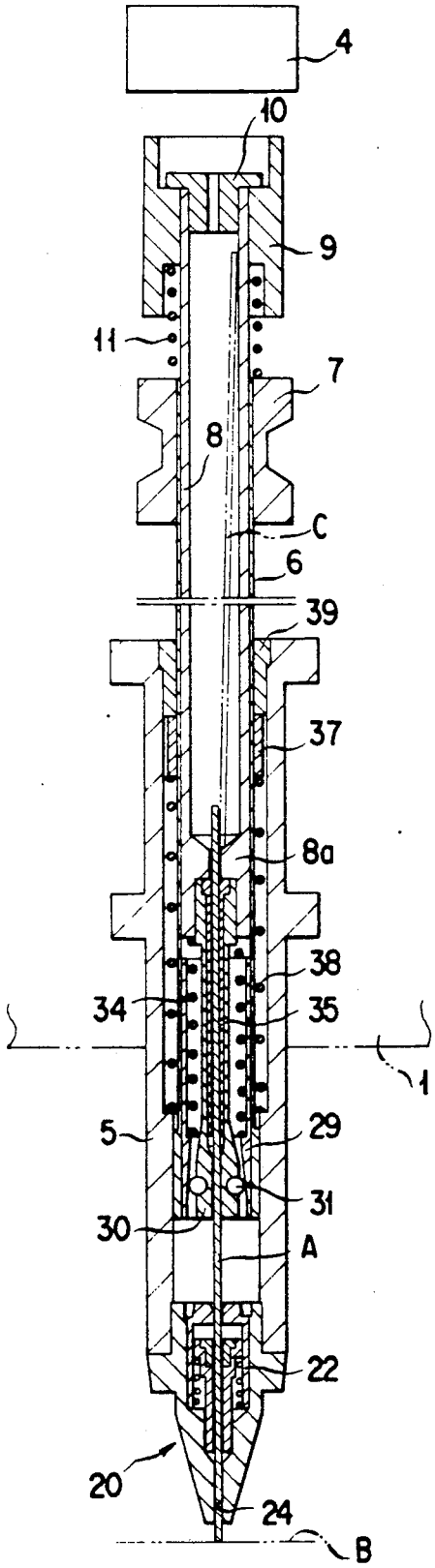
FIGS. 2, 3 and 4 are explanatory views showing operations of the first embodiment.

During drawing operation, as shown in FIG. 2, the knocker 4 is moved upwards away from the regulating piece 9, and the base 1 is moved towards a drawing paper B in such a way as to press a lead A against it. Reference character C denotes a spare lead.

At that time, since the lead chuck 30 is biased upwards relative to the chuck ring 29 by the resilient forces of the coiled spring 34 and the auxiliary coiled spring 11, the lead holding force of the lead chuck 30 is increased so that a sufficient drawing pencil depressing pressure can be obtained without any upward sliding movement of the lead A relative to the lead chuck 30 due to the drawing pencil depressing pressure which occurs when drawing operation is conducted.

Figure 3:
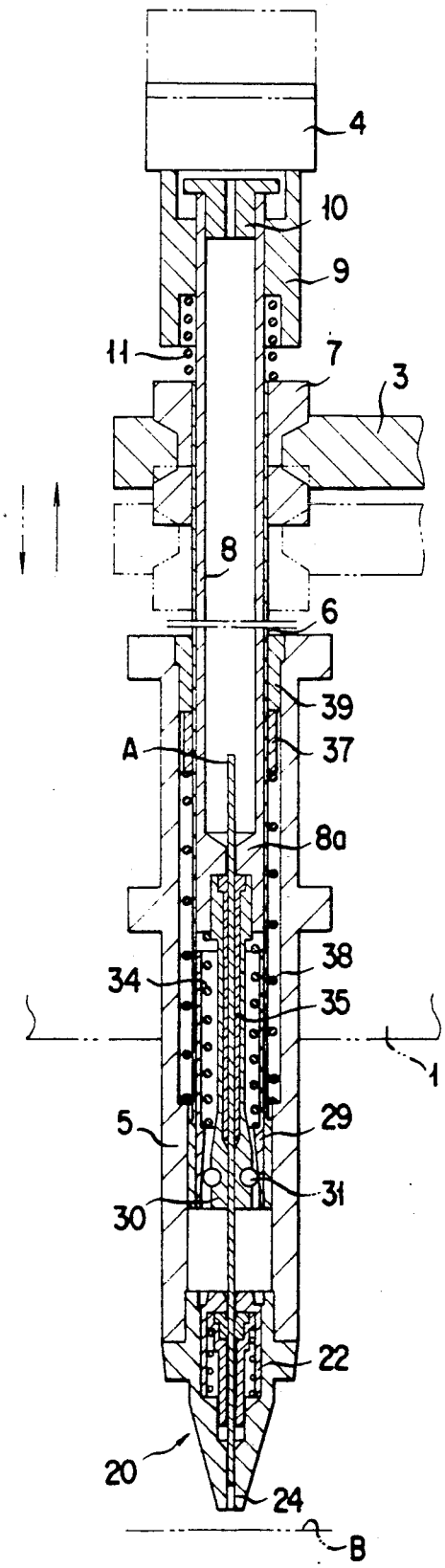

When it is desired to conduct lead thrusting operation, as shown in FIG. 3, the knocker 4 is moved down to move the regulating piece 9 down relative to the pipe member 6 to thereby keep the regulating piece 9 away from the stopper 10.

Figure 4:
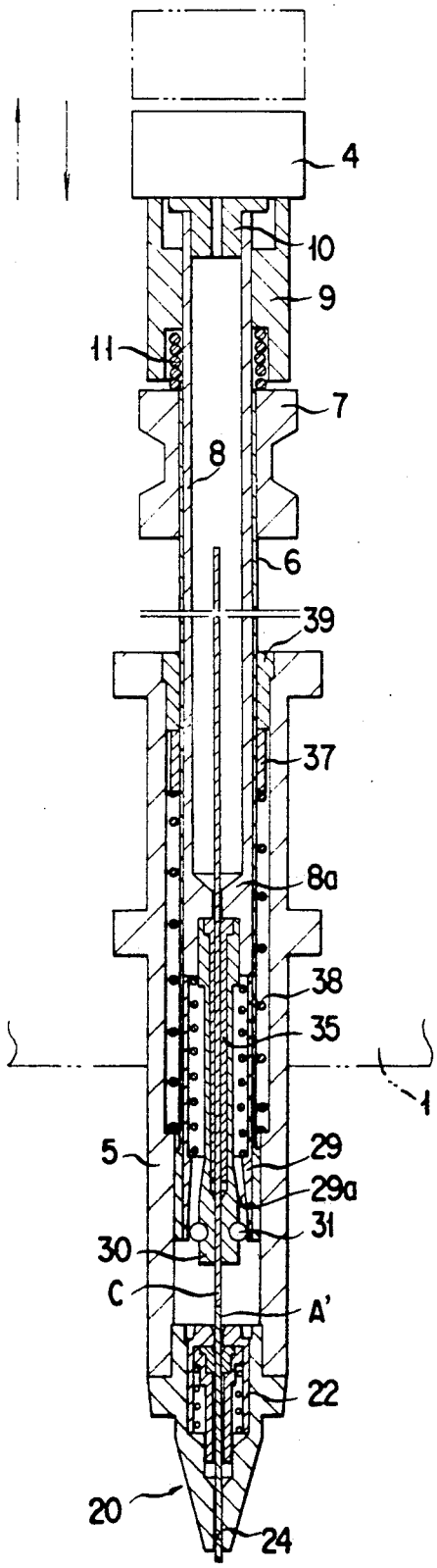

Consequently, the resilient force of the auxiliary coiled spring 11 is supported by the knocker 4 through the regulating piece 9 and becomes not to be exerted on the lead stock 8, with the result that the lead chuck 30 is biased upwards relative to the chuck ring 29 only by the resilient force of the coiled spring 34. As a result, the lead holding force of the lead chuck 30 becomes weaker than that when the above-mentioned operation is conducted, so that the lead A can be thrust down in the same manner as in the prior art example by moving the pipe member 6 down by means of the driving arrangement 3 through the sleeve 7 by a predetermined stroke.

when it is desired to supplement or supply the spare lead C, as shown in FIG. 4, the knocker 4 is moved down further so as to push the stopper 10 down to thereby move the lead stock 8 down relative to the pipe member 6.

This causes the lead chuck 30 to be moved downwards relative to the chuck ring 29 to disengage the steel balls 31 from the inner peripheral surface 29*a* of the chuck ring 29 thereby expanding the lead chuck 30 so that the spare lead C in the lead stock 8 may drop until it is abutted against the top end of the residual lead A' in the same manner as in the prior art example to thereby enable the residual lead A' to be expelled and drawing operation to be conducted with the spare lead C.

Figure 5:
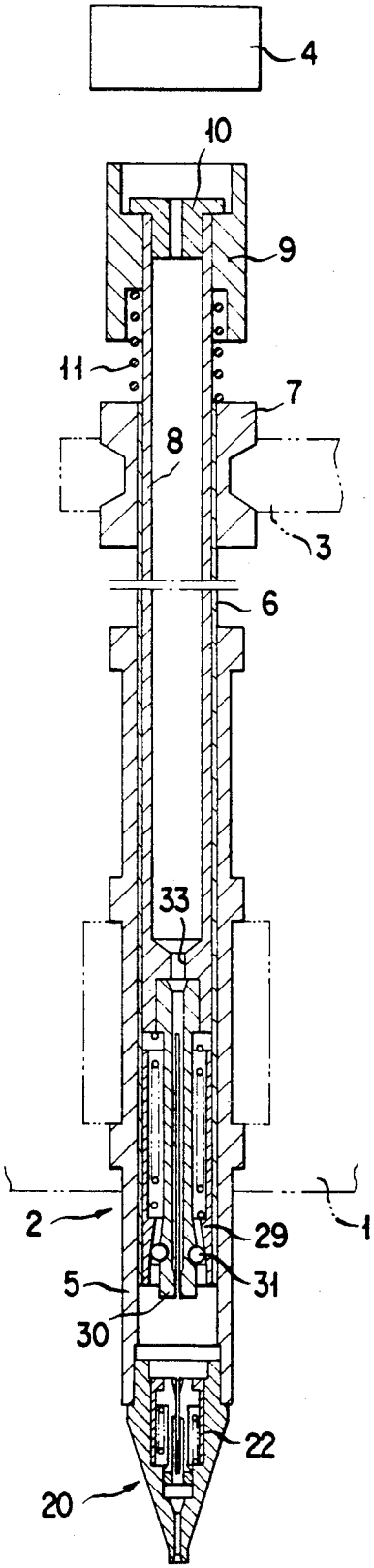
FIG. 5 is a longitudinal sectional view showing a second embodiment of the present invention.
Figure 6:
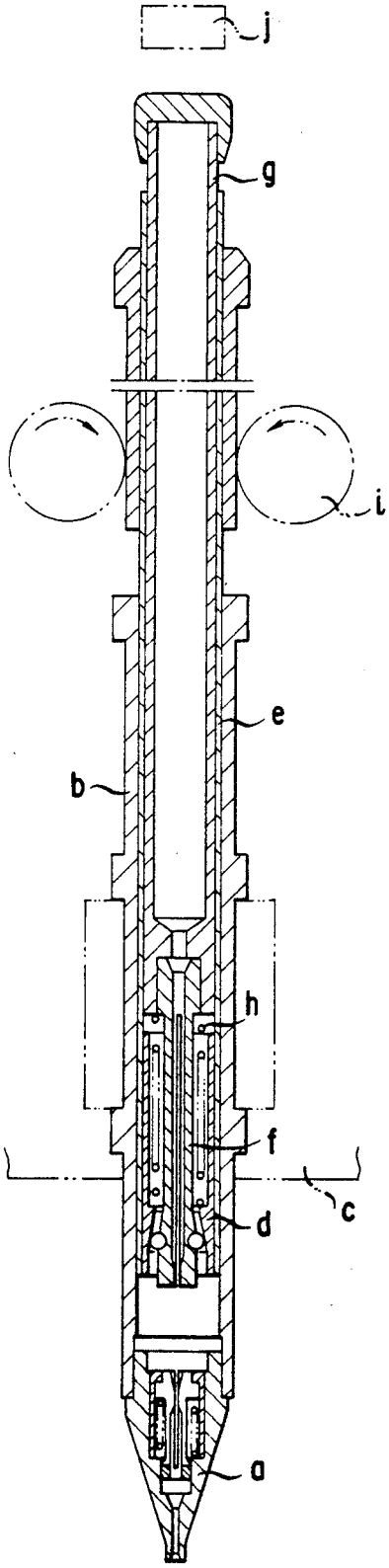
FIG. 6 is a longitudinal sectional view of a prior art example.

While in the above-mentioned embodiment the engaging piece 37, the coiled spring 38 and the stopper 39 are provided, an alternative arrangement as shown in FIG. 5 wherein such component parts are omitted can be made.

As described in detail hereinabove, according to the present invention, when drawing operation is made, the knocker 4 is moved upwards away from the regulating piece 9 so that the lead chuck 30 fixedly secured to the lead stock 8 is biased upwards relative to the chuck ring 29 fixedly secured to the pipe member 6 by the resilient forces of the coiled spring 34 and the auxiliary coiled spring 11, thus increasing the lead holding force of the lead chuck 30 so as to provide a sufficient drawing pencil depressing force during the drawing operation.

Whilst, when it is desired to thrust the lead, the knocker 4 is moved down to move the regulating piece 9 down towards the lead chuck 30 so that the resilient force of the auxiliary coiled spring 11 becomes to be supported by the knocker and becomes not to be transmitted to the lead chuck 30, thus reducing the lead holding force of the lead chuck 30. As a result, the lead can be thrust out by moving the pipe member 6 down and up.

It is to be understood that the foregoing description is merely illustrative of preferred embodiments of the present invention, and that the scope of the present invention is not to be limited thereto, but is to be determined by the scope of the appended claims.

What is claimed is:

1. A drawing device for use in a drafting machine including one length of long casing fixedly secured to a base serving as a holder, said casing having a leading end and a rear end; a lead guide fixedly secured to the leading end of the casing; one length of long pipe member inserted into said casing from said rear end of said casing in such a manner as to be axially slidably moved freely; a chuck ring fixedly secured to the interior of a leading end portion of the pipe member; a sleeve fitted closely over and fixedly secured to the outer peripheral surface of an end side portion of said pipe member, said sleeve being connected to a driving arrangement; one length of a lead stock having a leading end inserted into said pipe member in such a manner as to be slidably moved freely and in opposed relationship to a rear end of said chuck ring, said lead stock having a centrally and axially extending lead insertion hole formed in a leading end side thereof, and also a lead stock space formed therein so as to extend axially from the lead insertion hole to a rear end side of said casing; a lead chuck fixedly secured to the leading end of said lead stock in such a manner that a leading end side portion of said lead chuck may be radially deformed or expanded and contracted in cooperation with said chuck ring, said lead chuck having a centrally extending lead insertion hole formed therein and in aligned relationship with the lead insertion hole in the lead stock; a compression coiled spring mounted between said chuck ring and said lead stock so as to bias normally said lead stock and said lead chuck, toward the rear end of said casing, in a longitudinal direction relative to said pipe member and said chuck ring; and means for radially deforming or contacting the lead chuck to enable the lead stock to hold a lead firmly when said lead chuck is biased by resilient force of the coiled spring; a regulating piece fitted over a rear end of said lead stock in such a manner as to be slidably moved freely by a predetermined stroke, an auxiliary compression coiled spring mounted between said regulating piece and said sleeve so as to normally bias the regulating piece towards the rear end of said lead stock, and a knocker provided movably up and down above said regulating piece so as to move said regulating piece down.

2. The drawing device for use in a drafting machine as claimed in claim 1, characterized in that the inner peripheral surface of said casing is divided into a leading end side portion having a small diameter and a rear end side portion having a large diameter, which are bounded by a stepped portion formed on the approximately intermediary part thereof; the leading end portion of said pipe member is slidably inserted in the small diameter portion, whilst an annular space is defined between the inner peripheral surface of said large diameter portion and the outer peripheral surface of said pipe member; and that a sleeve position keeping arrangement is formed in said annular space and is comprised of a ring-shaped engaging piece fixedly secured to the outer periphery of the approximately intermediary part of said pipe member and arranged to be moved freely together with the pipe member in the annular space in the longitudinal direction of the pipe member; a stopper fixedly secured to the end of the opening of said large diameter portion so as to block said annular space; and a compression coiled spring mounted between said ring-shaped engaging piece and the stepped portion formed in said casing to bias said ring-shaped engaging piece so as to abut against said stopper.

* * * * *